US005962202A

United States Patent [19]

Sampei

[11] Patent Number: 5,962,202

[45] Date of Patent: Oct. 5, 1999

[54] METHOD FOR PROCESSING BLACK-AND-WHITE SILVER HALIDE PHOTOGRAPHIC LIGHT-SENSITIVE MATERIAL

[75] Inventor: Takeshi Sampei, Hino, Japan

[73] Assignee: Konica Corporation, Japan

[21] Appl. No.: 08/982,151

[22] Filed: Dec. 1, 1997

[30] Foreign Application Priority Data

Dec. 3, 1996 [JP] Japan ..... 8-322646

[51] Int. Cl.[6] ..... G03C 5/29

[52] U.S. Cl. ..... 430/440; 430/446; 430/488

[58] Field of Search ..... 430/440, 446, 430/488

[56] References Cited

U.S. PATENT DOCUMENTS

| | | | |
|---|---|---|---|
| 5,194,367 | 3/1993 | Yamada et al. | 430/363 |
| 5,503,965 | 4/1996 | Okutsu | 430/399 |
| 5,578,414 | 11/1996 | Yamamoto et al. | 430/264 |
| 5,578,433 | 11/1996 | Morishima et al. | 430/436 |
| 5,587,276 | 12/1996 | Katoh | 430/440 |
| 5,721,094 | 2/1998 | Komatsu et al. | 430/446 |

FOREIGN PATENT DOCUMENTS

| | | |
|---|---|---|
| 0518352 | 12/1992 | European Pat. Off. . |
| 0793140 | 9/1997 | European Pat. Off. . |

OTHER PUBLICATIONS

European Search Report EP 97 30 9612, Mar. 1998.

XP–002059150 Derwent—Abstract, JP7104442 Apr. 1995.

XP–002059151 Derwent—Abstract, JP8076324 Mar. 1996.

*Primary Examiner*—Hoa Van Le

*Attorney, Agent, or Firm*—Jordan B. Bierman; Bierman, Muserlian and Lucas

[57] ABSTRACT

A method for processing a black-and-white silver halide photographic light-sensitive material. The method comprises the steps of (1) developing the black-and-white photographic light-sensitive material containing a quaternary onium compound with a developer containing ascorbic acid or a derivative thereof and having a pH value of from 8.0 to 10.0, (2) fixing the light-sensitive material, (3) washing the light-sensitive material by an automatic processor having a multi-step counter flow washing system, and (4) drying the light-sensitive material.

5 Claims, 1 Drawing Sheet

METHOD FOR PROCESSING BLACK-AND-WHITE SILVER HALIDE PHOTOGRAPHIC LIGHT-SENSITIVE MATERIAL

FIELD OF THE INVENTION

This invention relates to a method for processing a black-and-white silver halide photographic light-sensitive material, particularly relates to a method for processing a black-and-white silver halide photographic light-sensitive material which is suitable for graphic art and rapid processing, and reduction of the replenishing amount of processing solution and inhibition of variation of photographic property can be realized thereby.

BACKGROUND OF THE INVENTION

Recently, regulation on waste liquids exhausted from the processing laboratory of photographic light-sensitive material become serious for protecting the earth environment. Accordingly, in the field of photographic industry, a great deal of effort was put into reduction of the amount of waste liquid to a limiting amount. Reduction of the waste liquid by reducing the replenishing amount of a processing solution is strongly demanded also in the field of graphic arts, and various methods for attaining such the object have been investigated.

A silver halide photographic light-sensitive material for graphic arts use, hereinafter referred to a light-sensitive material, is usually treated by processes of development, fixing and washing or stabilizing, after imagewise exposed. The developer is usually a alkaline solution containing a dihydroxybenzene such as hydroquinone as a developing agent, a aminophenol compound or a 3-pyrazolidone compound as an assistant developing agent and a sulfite as a preservant. Such the developer has a high pH value such as 10.3 or more for satisfying the requirements of forming extreme high contrast image and suitability for rapid processing. Therefore, it is actual situation that the developer is not always stable since the developer is easily degraded by oxidation, and the stability of the developer is not satisfactory to resist to reducing the replenishing amount.

In the light-sensitive material for graphic arts use, photographic technology for forming an extreme high contrast image is required since an image constituted by dots is used in the graphic arts. As such the technique, a light-sensitive material containing a hydrazine compound described in U.S. Pat. No. 4,269,929 has been known. However, the extreme high contrast image cannot be reproduced in such the light-sensitive when a stable developer having a lowered pH value is used to reduce the replenishing amount of the developer.

A method using a quaternary onium compound such as a pyridinium salt described in Japanese Patent Publication Open for Public Inspection (JP O.P.I.) No. 6-102633 has been known as a technique to form the extreme high contrast image by a developer having a pH value of less than 10.0. An idea of optimizing the image reproduction and reduction of the replenishing amount by the use of a hydrazine derivative and a quaternary onium compound in combination has also been known, which is described in JP O.P.I. No. 8-44005.

However, fluctuation of the photographic properties is caused in the course of a running of processing of the light-sensitive material containing the quaternary onium compound when the processing is performed by using a developer having a pH value of not more than 10. Particularly, problems of color remaining after processing and degradation of storage ability of the image are found. For example, the remained color is intensified and the image density is lowered when the light-sensitive material is stood under a high humid and high temperature condition. The fluctuation of the photographic properties is further increased when the processing time is shortened.

SUMMARY OF THE INVENTION

The object of the invention is to provide a processing method for a black-and white photogrpahic light-sensitive material, particularly a photographic material for graphic arts use, by which fluctuation of photographic properties such as color remaining is reduced and an image excellent in the storage ability can be obtained even when the processing is carried out by the using of a developer having a pH value of not more than 10 under a condition in which the replenishing amount of the processing solution and the processing time are considerably reduced.

The object of the invention is attached by a method for processing a black-and-white photographic light-sensitive material comprising the steps of (1) developing the black-and-white photographic light-sensitive material containing a quaternary onium compound with a developer containing ascorbic acid or a derivative thereof and having a pH value of from 8.0 to 10.0, (2) fixing the light-sensitive material, (3) washing the light-sensitive material by an automatic processor having a multi-step counter flow washing system, and (4) drying the light-sensitive material.

DETAILED DESCRIPTION OF THE INVENTION

Figure 1:
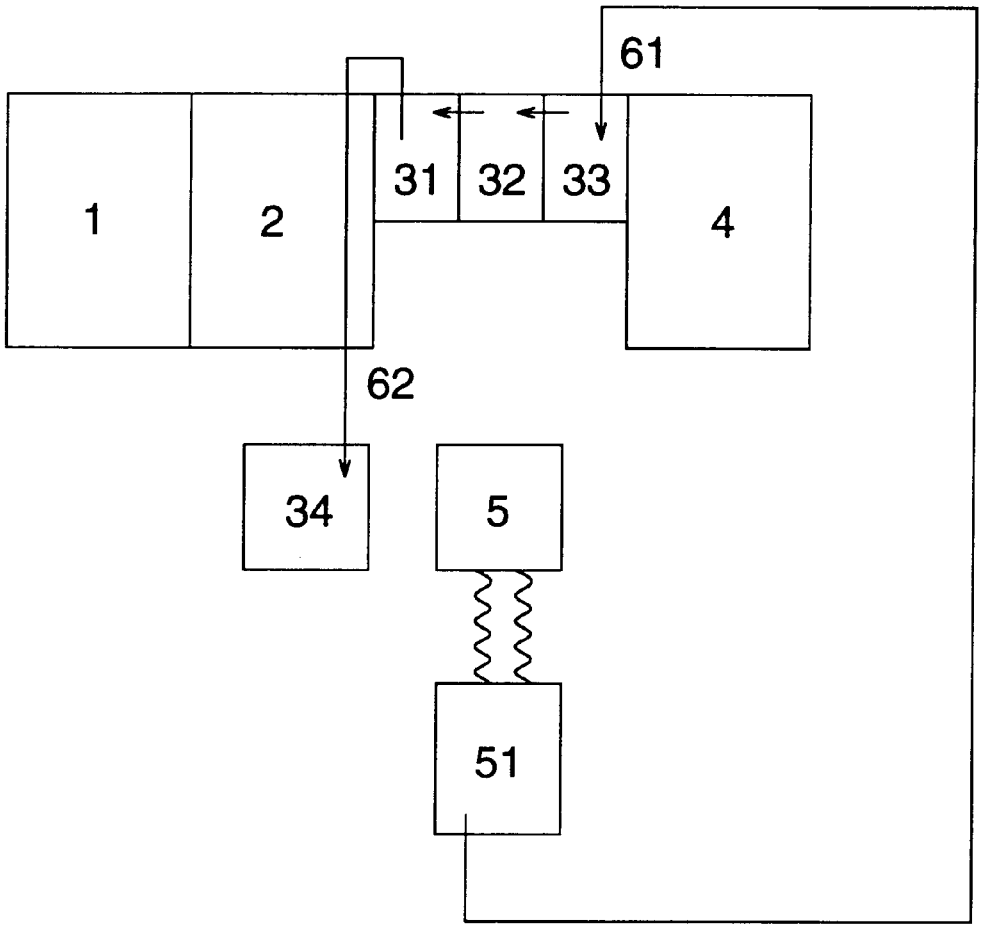
FIG. 1 shows a shima of an automatic processor having a multi-step counter flow washing system.

When a light-sensitive material containing the quaternary onium compound is processed with a containing ascorbic acid or its derivative and having a pH value of 8.0 to 10.0 capable of forming the extreme high contrast image and reducing the replenishing amount, the decolorization of a dye contained in the light-sensitive material and the stability of the silver image tend to be insufficient. It is considered that the fluctuation of the photographic properties is caused by the insufficient decolorization and the stability of the silver image. The inventor has found that the above-mentioned problem can be compensated by improvement of the washing procedure.

The invention is described in detail as to each items below.

<Light-sensitive Material>

The light-sensitive material used in the invention contains a quaternary onium compound.

The quaternary onium compound to be used in the invention is a compound having a quaternary cation of a nitrogen atom or a phosphor atom in the molecular thereof, and preferably a compound represented by the following Formula P Formula P

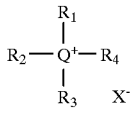

In the formula, Q is a nitrogen atom or a phosphor atom, $R_1$, $R_2$, $R_3$ and $R_4$ are each a hydrogen atom or a substituent provided that at least one of $R_1$, $R_2$, $R_3$ and $R_4$ is the substituent other than the hydrogen atom, $X^-$ is an anion, $R_1$ through $R_4$ may be bonded with each other to form a ring.

The substituent represented by $R_1$ to $R_4$ includes an alkyl group such as methyl group, ethyl group, propyl group, butyl group, hexyl group or cyclohexyl group, an alkenyl group such as allyl group or butenyl group, an alkynyl group such as propagyl group or butinyl group, an aryl group such as phenyl group or naphthyl group, a heterocyclic group such as pipelydinyl group, piperadinyl group, morpholinyl group, pyridyl group, furyl group, thienyl group, tetrahydrofuryl group, tetrahydrothienyl group or sulforanyl group, and an amino group. The ring formed by bonding of each of $R_1$ through $R_4$ includes a piperidine ring, a morpholine ring, a piperazine ring, a quinuclidine ring, a pyridine ring, a pyrrole ring, an imidazole ring, a triazole ring and a tetrazole ring. The group represented by $R_1$ through $R_4$ each may have a substituent such as a hydroxyl group, an alkoxy group, an aryloxy group, a carboxyl group, sulfo group, an alkyl group or an aryl group.

$R_1$, $R_2$, $R_3$ and $R_4$ are preferably a hydrogen atom or an alkyl group.

The anion represented by $X^-$ includes an inorganic ion and an organic ion such as a halogen ion, a sulfate ion, a nitrate ion, an acetate ion and a p-toluenesulfonate ion.

Furthermore, aS the compound represented by Formula P, a compound represented by the following Formula Pa, Pb, Pc or a compound represented by the following Formula T is preferred.

Formula Pa

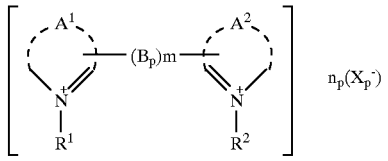

Formula Pb

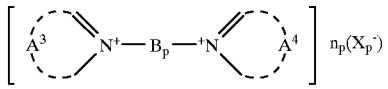

Formula Pc

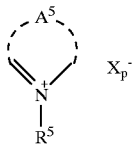

In the formulas, $A^1$, $A^2$, $A^3$, $A^4$ and $A^5$ are each a group of non-metal atoms necessary for completing a nitrogen-containing heterocyclic group which may contain a oxygen atom, a nitrogen atom or a sulfur atom, and a benzene ring may be condensed therewith. The heterocyclic ring formed by $A^1$, $A^2$, $A^3$, $A^4$ or $A^5$ may independently has a substituent. The substituent may be the same or different. As the substituent, the following groups can be cited: an alkyl group, an aryl group, an aralkyl group, an alkenyl group, an alkynyl group, a halogen atom, an acyl group, an alkoxycarbonyl group, an aryloxy-carbonyl group, a sulfo group, a carboxyl group, a hydroxy group, an alkoxy group, an aryloxy group, an amido group, a sulfamoyl group, a carbamoyl group, a ureido group, an amino group, a sulfonamido group, a sulfonyl group, a cyano group, a nitro group, a mercapto group, an alkylthio group and arylthio group. Preferable examples of $R^1$, $R^2$ and $R^5$ include a 5- or 6-member ring such as a ring of pyridine, imidazole, thiazole, oxazole, pyrazine or pyrimidine. More preferable group is pyridine ring.

$B_p$ is a di-valent bonding group, m is 0 or 1. As the two-valent bonding group, an alkylene group, an arylene group, an alkenylene group, —$SO_2$—, —SO—, —O—, —S—, —CO—, —N($R^6$)— in which $R^6$ represents an alkyl group, an aryl group or a hydrogen atom, or a group constituted by a combination thereof. $B_p$ is preferably an alkylene group or a alkenylene group.

$R^1$, $R^2$ and $R^5$ are each a substituted or unsubstituted alkyl group having 1 to 20 carbon atoms. $R^1$, $R^2$ and $R^5$ may be the same or different. The substituent is the same as the substituents described as that of $A^1$, $A^2$, $A^3$, $A^4$ and $A^5$. Preferable example of $R^1$, $R^2$ and $R^5$ is an alkyl group having 4 to 10 carbon atoms. Further referable example is a substituted or unsubstituted aryl group.

$X_p^-$ is a counter ion necessary to neutralize the charge in the molecule, for example, a chloride ion, a bromide ion, an iodide ion, a nitrate ion, a sulfate ion, a p-toluenesulfonate ion or an oxalate ion. $n_p$ is a number of the counter ion necessary to neutralize the charge in the molecule, and $n_p$ is zero when an intramolecular salt is formed.

Formula T

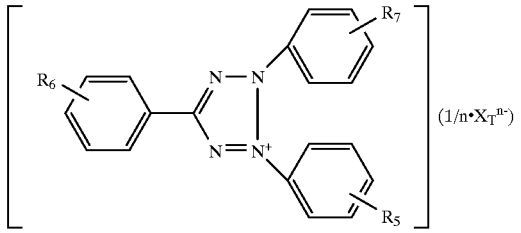

The substituents $R_5$, $R_6$ and $R_7$ of the phenyl groups in a tetrazolium compound represented by Formula T are each a hydrogen atom or a group having a negative Hammett's sigma value (σP) showing the electron attractivity.

The Hammett's sigma value in a phenyl group can be found in various documents, for example, C. Hansch, Journal of Medical chemistry, 20, 304, 1997. As particularly preferable groups having a negative sigma value, for example, a methyl group (σP=−0.17), an ethyl group (−0.15), a cyclopropyl group (−0.210), a n-propyl group (−0.13), an iso-propyl group (−0.15), a cyclobutyl group (−0.15), a n-butyl group (−0.16), an iso-butyl group (−0.20), a n-pentyl group (−0.15), a cyclohexyl group (−0.22), an amino group (−0.66), an acetylamino group (−0.15), a hydroxyl group (−0.37), a methoxy group (−0.27), an ethoxy group (−0.24), a propoxy group (−0.25), a butoxy group (−0.32) and a pentoxy group (−0.34) are cited. These groups are advantageous for the substituent of the compound represented by Formula [T].

n is 1 or 2. As the anion represented by $X_t^{n-}$, the following anions can be cited; a halogen ion such as a chloride ion, a bromide ion or an iodide ion, an acid root of an inorganic acid such as nitric acid, sulfuric acid or perchloric acid, an acid root of an organic acid such as sulfonic acid or carboxylic acid, an anionic surfactant, concretely, a lower alkylbenzenesulfonate anion such as p-toluenesulfonate anion, a higher alkylbenzenesulfonate anion such as p-dodecylbenzenesulfonate anion, a higher alkyl sulfate anion such as lauryl sulfate anion, a boron-containing anion such as tetraphenyl boron, a dialkylsulfosuccinate anion such as di-2-ethylhexyl sulfosuccinate anion, a higher aliphatic acid anion such as cetyl polyethenoxysulfate anion and a polymer having an acid root such as polyacrylic acid anion.

Although examples of the quaternary onium compound are described below, the invention is not limited thereto.

P-1

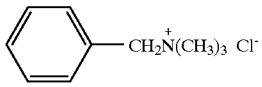

P-2 $C_{16}H_{33}{}^{+}N(CH_3)_3\ Br^{-}$

P-3 ${}^{+}N(C_4H_9)_4\ Cl^{-}$

P-4 $(CH_3)_3{}^{+}NCH_2CH_2OH\ Cl^{-}$

P-5

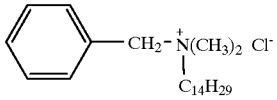

P-6

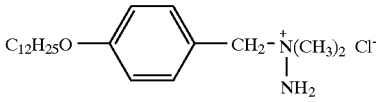

P-7

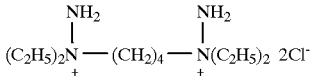

P-8 $(C_4H_9)_3{-}N^{+}{-}CH_2CH_2{-}N^{+}(C_4H_9)_3\ 2\ SO_4^{-}$

P-9 $(C_2H_5)_3{}^{+}N{-}(CH_2)_8{-}{}^{+}N(C_2H_5)_3\ 2\ Cl^{-}$

P-10

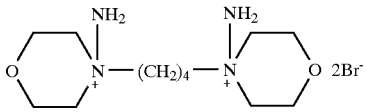

P-11

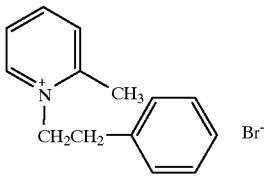

P-12

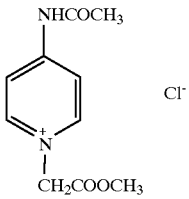

P-13

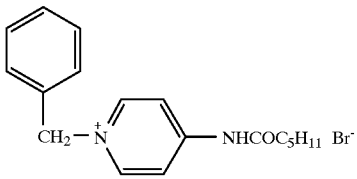

-continued
P-14
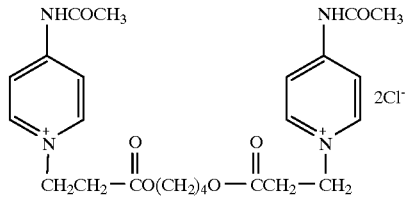
P-15
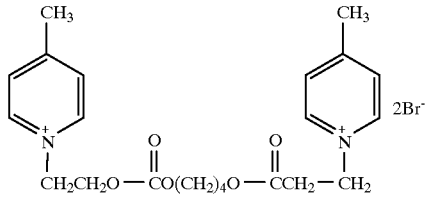
P-16
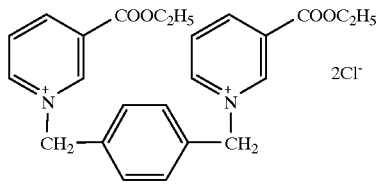
P-17
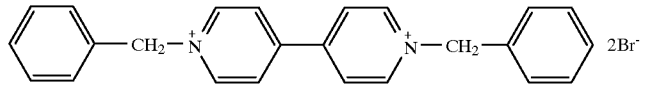
P-18
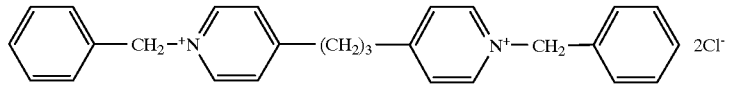
P-19
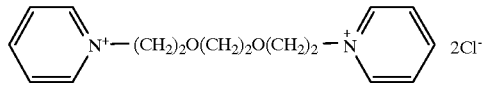
P-20
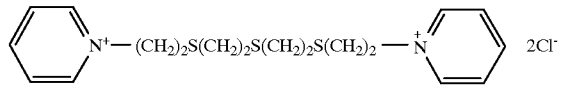
P-21
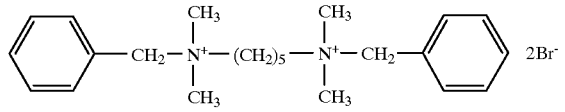
P-22
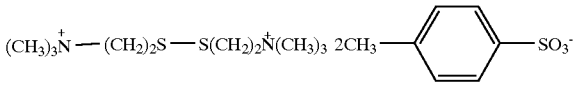
P-23
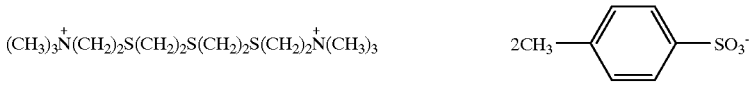
P-24
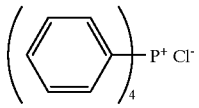

-continued
P-25
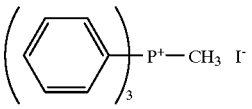
P-26
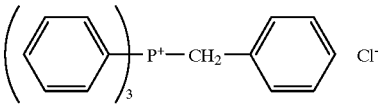
P-27
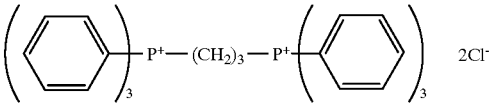
P-28 $(C_4H_9)_3—P^+—C_{16}H_{33}\ Br^-$
P-29
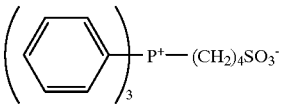
P-30
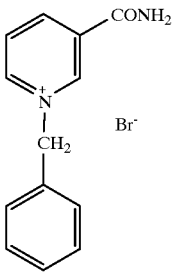
P-31
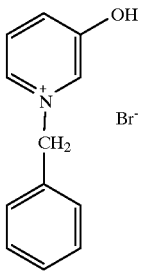
P-32
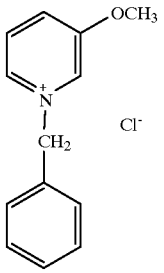

-continued
P-33
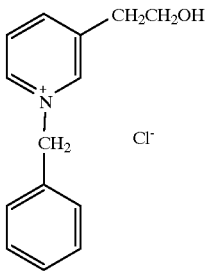
P-34
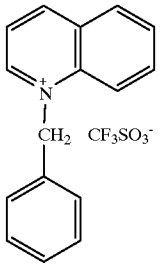
P-35
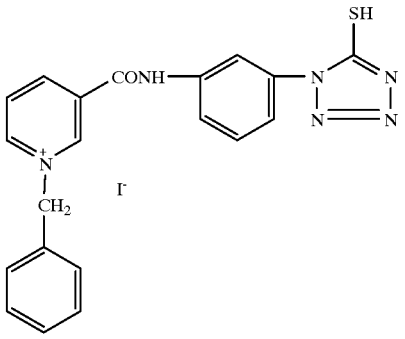
P-36
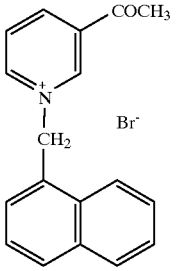
P-37
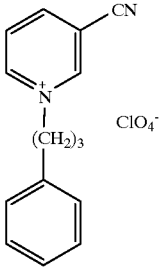

-continued
P-38
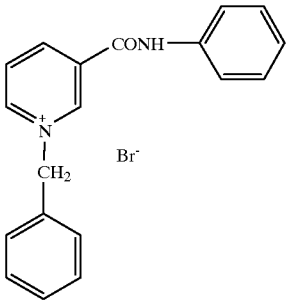
P-39
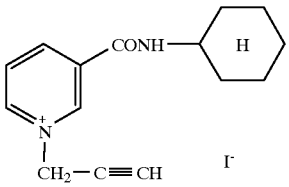
P-40
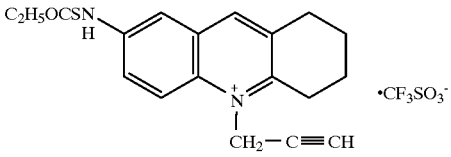
P-41
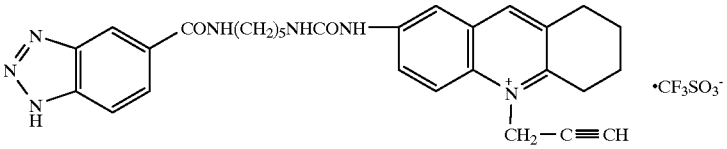
P-42
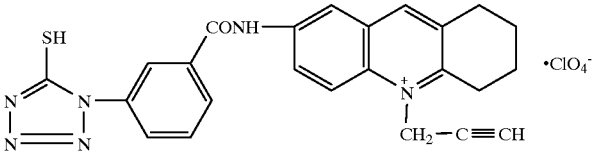
P-43
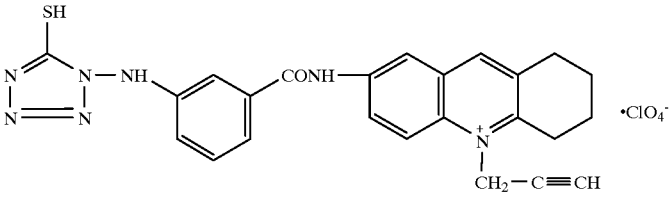
P-44
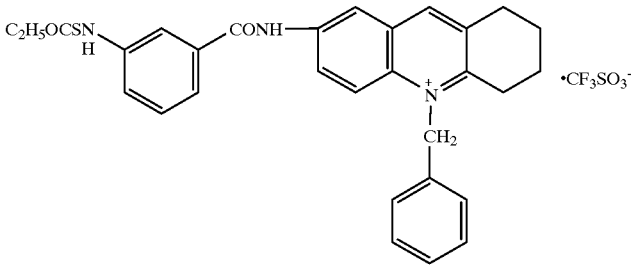

-continued
P-45
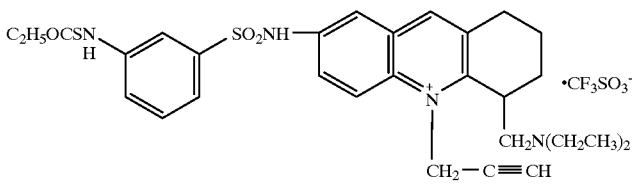
P-46
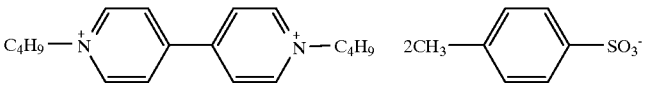
P-47
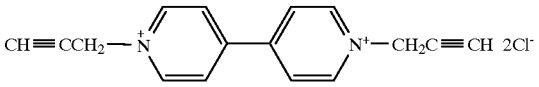
P-48
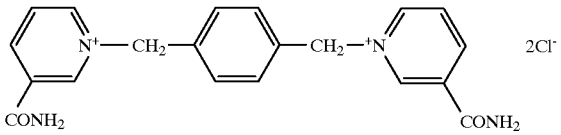
P-49
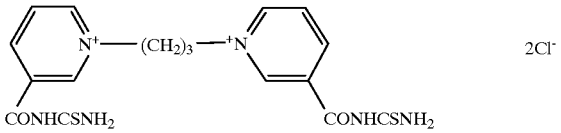
P-50
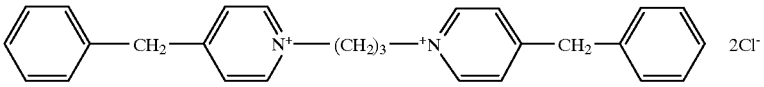
P-51
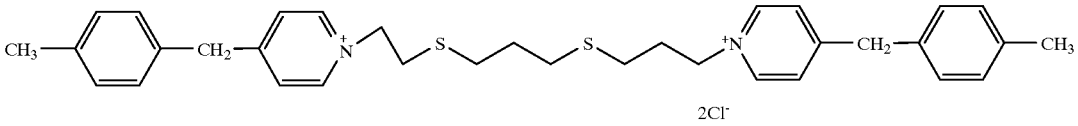
P-52
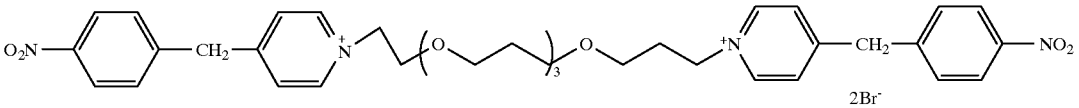
P-53
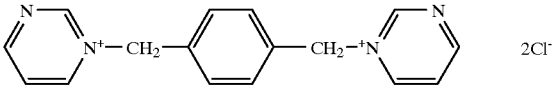
P-54
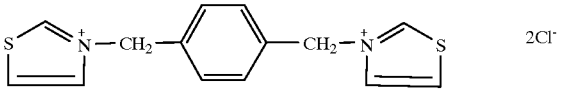
P-55
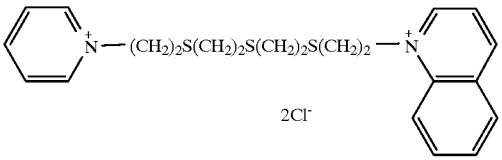

-continued

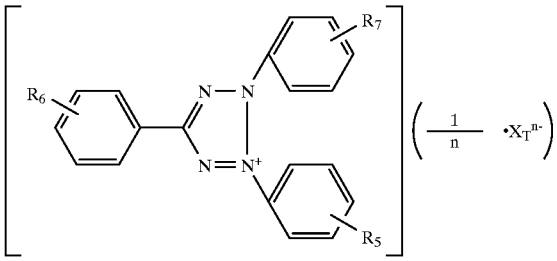

| Compound No. | $R_5$ | $R_6$ | $R_7$ | $X_T^{n-}$ |
|---|---|---|---|---|
| T-1 | H | H | p-$CH_3$ | $Cl^-$ |
| T-2 | p-$CH_3$ | H | p-$CH_3$ | $Cl^-$ |
| T-3 | p-$CH_3$ | p-$CH_3$ | p-$CH_3$ | $Cl^-$ |
| T-4 | H | p-$CH_3$ | p-$CH_3$ | $Cl^-$ |
| T-5 | p-$OCH_3$ | p-$CH_3$ | p-$CH_3$ | $Cl^-$ |
| T-6 | p-$OCH_3$ | H | p-$CH_3$ | $Cl^-$ |
| T-7 | p-$OCH_3$ | H | p-$OCH_3$ | $Cl^-$ |
| T-8 | m-$C_2H_5$ | H | m-$C_2H_5$ | $Cl^-$ |
| T-9 | p-$C_2H_5$ | p-$C_2H_5$ | p-$C_2H_5$ | $Cl^-$ |
| T-10 | p-$C_3H_7$ | H | p-$C_3H_7$ | $Cl^-$ |
| T-11 | p-iso$C_3H_7$ | H | p-iso$C_3H_7$ | $Cl^-$ |
| T-12 | p-$OC_2H_5$ | H | p-$OC_2H_5$ | $Cl^-$ |
| T-13 | p-$OCH_3$ | H | p-iso$C_5H_7$ | $Cl^-$ |
| T-14 | H | H | p-n$C_{12}H_{25}$ | $Cl^-$ |
| T-15 | p-n$C_{12}H_{25}$ | H | p-n$C_{12}H_{25}$ | $Cl^-$ |
| T-16 | H | p-$NH_2$ | H | $Cl^-$ |
| T-17 | p-$NH_2$ | H | H | $Cl^-$ |
| T-18 | p-$CH_3$ | H | p-$CH_3$ | $ClO_4^-$ |

The above-mentioned quaternary onium compound can be easily synthesized according to a known method, for example, the method described in Chemical Review 55, p.p. 335–483, can be referred.

The adding amount of the quaternary onium compound is usually $1\times10^{-8}$ moles to 1 mole, preferable $1\times10^{-7}$ moles to $1\times10^{-1}$ moles, per mole of silver halide. The compound can be added to the light-sensitive material at an optional step of from the formation of silver halide grain to the coating of the light-sensitive material.

The quaternary onium compound may be used solely or in combination of two or more kinds thereof. Although the compound may be added to any layer of the layers constituting the light-sensitive material, preferably to be added in at least one layer provided on the silver halide emulsion layer coated side, more preferably in the silver halide emulsion layer and/or a layer adjacent to the silver halide emulsion layer.

In the invention, a hydrazine derivative can be added as an agent for making a extreme high contrast additionally to the quaternary onium compound.

The silver halide composition of the silver halide emulsion to be used in the light-sensitive material relating to the invention is preferably silver chlorobromide or silver chloroiodobromide having a silver chloride content of 50 to 85 mole-%. The average diameter of the silver halide grains is preferably not more than 0.7 $\mu$m, particularly preferably 0.3 to 0.1 $\mu$m. The silver halide grains may have any shapes such as tabular, spherical, cubic, tetradecahedral, or regular octahedral. The distribution of the grain size is preferably narrow, an emulsion so-called monodisperse emulsion is preferred in which the number of grains each having a size within the range of ±40% of the average grain size are accounting for 90%, more preferably 95%, of the whole number of grains.

It is preferred to add a salt of a transition metal of VIII group of the periodic table such as a cadmium salt, a zinc salt, a lead salt, a thallium salt, a ruthenium salt, an osmium salt, an iridium salt or a rhodium salt, or a complex salt containing one of such the metals to the emulsion at a step for forming or growing the silver halide grains. Rh and Re are particularly preferred. Preferable adding amount of the salt is $10^{-8}$ to $10^{-4}$ moles per mole of silver.

The silver halide emulsion and the preparation method thereof are described in detail in Research Disclosure 176, 17643, p.p. 22–23 (December 1978) or in the literatures cited therein.

It is preferred that the silver halide emulsion is chemically sensitized. The emulsion can be spectrally sensitized at desired wavelength by a sensitizing dye.

To the light-sensitive material, various compounds known as an anti-foggant or a stabilizing agent can be added for the purpose of preventing fogging in the course of producing, storage or photographic processing, and for stabilizing the photographic properties. The photographic emulsion layer and a non-light-sensitive hydrophilic colloid layer may contain a hardener. Furthermore, various kinds of known surfactants may be used for various purposes such as improving coating property, preventing static charge, improving the slipping property, emulsifying, preventing adhesion and improving in the photographic properties.

Gelatin is advantageously used as a binder or a protective colloid of the photographic emulsion. However, a hydrophilic colloid other than gelatin is also usable.

In the photographic emulsion usable in the invention, a polymer composed of the following monomer or a combination thereof can be used for the purpose of improving the dimensiton stability, for example, an alkyl acrylate, an alkyl methacrylate, an alkoxyacryl acrylate, an alkoxyacryl methacrylate, a glysigyl acrylate, a glysigyl acrylate, acrylamide, methacrylamide, a vinyl ester such as vinyl acetate, an acrylonitryl, an olefin, and styrene, or a combination of the above-mentioned and acrylic acid, methacrylic acid, α,β-unsaturated dicarboxylic acid, hydroxyalkyl acrylate, hydroxyalkyl methacrylate, sulfoalkyl acrylate, sulfoalkyl methacrylate or styrenesulfonic acid.

In the light-sensitive material relating to the invention, it is preferred to provide at least one electroconductive layer on the support. The method for forming the electroconductive layer includes a method to form the layer by using a water-soluble electroconductive polymer and a hydrophobic polymer hardening agent and a method to form the layer by using a metal oxide. For example, the method described in JP O.P.I. No. 3-265842 can be applied in such the methods.

The effects of the invention can be enhanced when the swelling rate of the light-sensitive material to be processed according to the invention is 30 to 250%, particularly 50 to 180%. The swelling rate is represented by the following equation, $$(d-d_0)/d\times 100\%$$

wherein $d_0$ is the thickness of the hydrophilic layer of the light-sensitive material measured after incubated at 38° C. and 50% RH for 3 days, and d is the thickness of the hydrophilic layer measured after swollen in distilled water at 20° C. for 3 minutes.

To the silver halide emulsion relating to the invention, various known techniques and additives can be applied, which are described in (RD) 176, 7643, (December 1978,) and (RD) 178, 8716 (November, 1979).

In the light-sensitive material relating to the invention, the emulsion layer and the protective layer each may be a single layer or multi-layers composed of two or more layers. When the layer is composed of multi-layers, an interlayer ma be provided between the layers.

The usable support includes cellulose acetate, cellulose nitrate, polyester such as polyethylene terephthalate, polyolefin such as polyethylene, barita paper, paper coated with polyolefin, glass and metal. The support is subbed according to necessity.

<Developer>

In the invention, it is preferred that ascorbic acid or its derivative is contained in the light-sensitive material or the developer. It is more preferable that ascorbic acid or its derivative is at least contained in the developer. The pH value of the developer is preferably 8.0 to 10.0, more preferably 8.5 to 9.8.

The ascorbic acid or a derivative thereof usable in the invention is a compound represented by Formula (A) or Formula (A-a).

Formula (A)

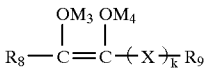

In the formula, $R_8$ and $R_9$ are each an alkyl group, an amino group, an alkoxyl group or an alkylthio group, the above-mentioned groups each may have a substituent, and $R_8$ and $R_9$ may be bonded to form a ring. k is 0 or 1, and when k=1, X represents —CO— or —CS—. $M_3$ and $M_4$ are each a hydrogen atom or an alkali metal atom.

Among the compounds represented by Formula (A), a compound represented by Formula (A-a) is preferable, in which $R_8$ and $R_9$ are bonded each other to form a ring.

Formula (A-a)

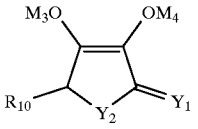

In the formula, $R_{10}$ represents a hydrogen atom, an alkyl group, an aryl group, an amino group, an alkoxyl group, a sulfo group, a carboxyl group, an amido group or a sulfonamido group, each of the above groups may has a substituent, $Y_1$ represents O or S, and $Y_2$ represents O, S or $NR_{11}$. $R_{11}$ represents a substituted or unsubstituted alkyl group or a substituted or unsubstituted aryl group. $M_3$ and $M_4$ represent each a hydrogen atom or an alkali metal.

The alkyl group in Formula (A) or (A-a) is preferably a lower alkyl group, for example, that having 1 to 5 carbon atoms. The amino group is preferably an unsubstituted amino group or an amino group substituted with a lower alkyl group. The alkoxyl group is preferably a lower alkoxyl group, and the aryl group is preferably a phenyl group or a naphthyl group. The above-mentioned groups each may have a substituted. A hydroxyl group, a halogen atom, an alkoxyl group, a sulfo group, an amido group and sulfonamide group are cited as the preferable substituents.

Although examples of the compound represented by Formula (A) or (A-a) are shown below, the compound is not limited thereto.

| Compound of Formula (A) | X | $R_8$ | $R_9$ | $M_3$ | $M_4$ |
|---|---|---|---|---|---|
| A-1 | — (k = 0) | $HOCH_2-CH(OH)-CH(OH)-$ | —OH | H | H |
| A-2 | — (k = 0) | $CH_3-CH(OH)-CH(OH)-$ | —OH | H | H |
| A-3 | — (k = 0) | $HOCH_2-CH(OH)-CH(OH)-$ | $-CH_3$ | H | H |

-continued

| | | | | | |
|---|---|---|---|---|---|
| A-4 | — (k = 0) | $CH_3—CH(OH)—CH(OH)—$ | $—CH_3$ | H | H |
| A-5 | $—C(=O)—$ (k = 1) | $HOCH_2—CH(OH)—CH(OH)—$ | —OH | H | H |
| A-6 | $—C(=O)—$ (k = 1) | $CH_3—CH(OH)—CH(OH)—$ | —OH | H | H |
| A-7 | $—C(=S)—$ (k = 1) | $HOCH_2—CH(OH)—CH(OH)—$ | —OH | H | H |
| A-8 | $—C(=S)—$ (k = 1) | $CH_3—CH(OH)—CH(OH)—$ | —OH | H | H |
| A-9 | $—C(=O)—$ (k = 1) | $HO—CH_2—$ | —OH | Na | H |
| A-10 | $—C(=O)—$ (k = 1) | $HO—CH_2—$ | $—CH_3$ | H | H |
| A-11 | $—C(=O)—$ (k = 1) | $HO—CH_2—$ | $—C_2H_5$ | H | H |
| A-12 | $—C(=O)—$ (k = 1) | $HO—CH_2—$ | $—C_2H_4OH$ | H | Na |

| Compound of Formula (A-a) | $Y_1$ | $Y_2$ | $R_{10}$ | $M_3$ | $M_4$ |
|---|---|---|---|---|---|
| A-13 | O | O | H | H | H |
| A-14 | O | O | $CH_3$ | H | H |
| A-15 | O | O | $CH_2(OH)$ | H | H |
| A-16 | O | O | $CH_3—CH(OH)—$ | H | H |
| A-17 | O | O | $HOCH_2—CH(OH)—$ | H | H |
| A-18 | O | O | $HOCH—CH(OH)—$ | Na | H |
| A-19 | O | O | $HOOCCH_2—CH(OH)—$ | H | Na |
| A-20 | S | O | H | Na | H |
| A-21 | S | O | $CH_3—CH(OH)—$ | H | H |
| A-22 | S | O | $HOCH_2—CH(OH)—$ | H | H |

-continued

| | | | | | |
|---|---|---|---|---|---|
| A-23 | O | $NCH_3$ | H | H | H |
| A-24 | O | NH | $HOCH_2-CH(OH)-$ | H | K |
| A-25 | O | S | H | H | H |
| A-26 | O | S | $HOCH_2-CH(OH)-$ | H | H |
| A-27 | O | S | $CH_3-CH(OH)-$ | H | H |
| A-28 | S | S | H | H | H |
| A-29 | S | S | $HOCH_2-CH(OH)-$ | H | H |
| A-30 | S | S | H | H | H |

These compounds are derivatives derived from ascorbic acid or erythorbic acid or a salt thereof, which are available on the market or easily synthesized by a known synthesizing method.

It is preferred to use an assistance developing agent together with the above-mentioned developing agent of ascorbic acid, erythorbic acid or their derivatives. The assistance developing agent includes 3-pyrazolidones (for example 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone and 1-phenyl-5-methyl-3-pyrazolidone), and aminophenols (for example, o-aminophenol, p-aminophenol, N-methyl-o-aminophenol, N-methyl-p-aminophenol and 2,4-diaminophenol). In such the case, the assistance developing agent of a 3-pyrazolidone or an aminophenol is used in an amount of 0.001 to 1.4 moles per liter of developer. The using amount of ascorbic acid, erythorbic acid or their derivatives is usually 0.05 to 1 moles per liter of developer. When ascorbic acid or its derivative is added into the light-sensitive material, the amount thereof is preferably 0.01 moles to 5 moles per mole of silver halide.

In the invention, it is preferable that hydroxybenzenes such as hydroquinone and methylhydroquinone are not used from the view point of the environment polution and photographic properties.

It is preferred to add a compound represented by Formula (S) to the developer of the invention to prevent the formation of silver sludge.

Formula (S)

$$Z_1—SM_1$$

In the formula, $Z_1$ is an alkyl group, an aromatic group or a heterocyclic group, each of which has a substituent selected from the group consisting of a hydroxy group, a an $—SO_3M_2$ group, a $—COOM_2$ group, an amino group and an ammonio group, or a group having a substituent selected from the group consisting of a hydroxy group, a an $—SO_3M_2$ group, a $—COOM_2$ group, an amino group, and an ammonio group, in which $M_2$ is a hydrogen atom, an alkali metal atom, an ammonium ion, $M_1$ is hydrogen atom, an alkali metal atom, or an amidino group. The above-mentioned ammonium ion, amino group represented by $M_2$ and the amidino group represented by $M_1$ each may have a substituent, and the amidino group may form a salt with a hydrogen halide acid, or a sulfonic acid.

In Formula S, the alkyl group represented by $Z_1$ is preferably a straight- or branched-chain alkyl group having 1 to 30 carbon atoms, particularly 2 to 20 carbon atoms, and the alkyl group may have a substituent furthermore the above-mentioned substituent. The aromatic group represented by $Z_1$ is preferably a single ring or condensed ring aromatic group having 6 to 32 carbon atom s, and the aromatic group may have a substituent furthermore the above-mentioned substituent. The heterocyclic group represented by $Z_1$ is preferably a single ring or condensed ring heterocyclic group having 1 to 23 carbon atoms, namely a 5- or 6-member ring including a hetero-atom independently selected from nitrogen atom, oxygen atom and sulfur atom therein, and the heterocyclic group may have a substituent furthermore the above-mentioned substituent. When the heterocyclic group is a tetrazole ring, the tetrazole ring does not have a substituted or unsubstituted naphthyl groups the substituent. Among the compounds represented by Formula S, a compound in which $Z_1$ is heterocyclic group having two or more nitrogen atoms, is preferred.

The ammonio group is preferable an ammonio group having not more than 20 carbon atoms, and the substituent thereof is a substituted or unsubstituted straight-chain, branched-chain or cyclic alkyl group such a s methyl group, ethyl group, benzyl group, ethoxypropyl group or cyclohexyl group, substituted or unsubstituted phenyl group or a naphthyl group.

Among compounds represented by Formula S, ones represented by Formula S-a are preferable.

Formula S-a

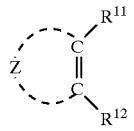

In the formula, Z represents a group of atoms necessary to form an unsaturated 5-member heterocyclic group or an unsaturated 6-member heterocyclic group each having a nitrogen ring such as a pyrrole ring, an imidazole ring, a pyrazole ring, a pyrimidine ring, a pyridazine ring or a pyrazine ring, which has at least one —$SM_1$ group or a thione group, and a substituent selected from consisting of a hydroxyl group, a —$COOM_1$ group, an —$SO_3M_1$ group, a substituted and unsubstituted amino group, and a substituted and unsubstituted ammonio group. In the formula, $R^{11}$ and $R^{12}$ are each a hydrogen atom, an —$SM_1$ group, a halogen atom, an alkyl group including one having a substitute, an alkoxyl group including one having a substitute, a hydroxyl group, a —$COOM_1$ group, an —$SO_3M_1$ group, an alkenyl group including one having a substitute, an amino group including one having a substitute, a carbamoyl group including one having a substitute, or a phenyl including one having a substitute, and a ring may be formed by bonding $R^{11}$ with $R^{12}$. Thus formed ring is a 5- or 6-member ring, preferably a nitrogen-containing ring. $M_1$ is the same as $M_1$ defined in Formula S. Z is preferably a group forming a heterocyclic group containing 2 or more nitrogen atoms, which may have a substituent furthermore the above-mentioned —$SM_1$ group or thione group. As such the substituent, a halogen atom, a lower alkyl group including one having a substituent, one having a 5 or less carbon atoms such as methyl group or ethyl group is preferred, a lower alkoxyl group including one having a substituent, one having a 5 or less carbon atoms such as methoxy group, ethoxy group or butoxy group is preferred, a lower alkenyl group including one having a substituent, one having a 5 or less carbon atoms is preferred, a carbamoyl group and phenyl group are preferable. A compound represented by the following Formulas A to E or F is preferred among the compounds represented by Formula S-a.

Formula A

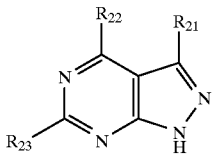

Formula B

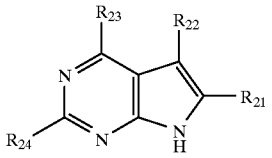

Formula C

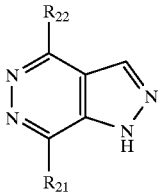

Formula D

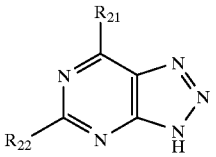

Formula E

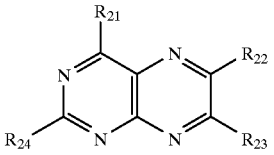

Formula F

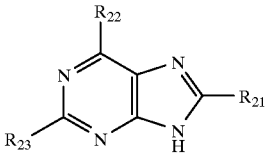

In the formulas, $R_{21}$, $R_{22}$, $R_{23}$ and $R_{24}$ are each a hydrogen atom, an —$SM_1$ group, a halogen atom, a lower alkyl group (including one having a substituent, and one having 5 or less carbon atoms such as a methyl group or an ethyl group is preferable), an alkoxy group (including one having a substituent, and one having 5 or less carbon atoms is preferable), a hydroxyl group, a —$COOM_2$ group, an —$SO_3M_5$ group, a lower alkenyl group (including one having a substituent, and one having 5 or less carbon atoms is preferable), an amino group, a carbamoyl group or a phenyl group. The compounds represented by Formula A to E or F has at least one —$SM_1$ group as the substituent represented by $R_{21}$, $R_{22}$, $R_{23}$ or $R_{24}$. $M_1$, $M_2$ and $M_5$ are each a hydrogen atom, an alkali metal atom or an ammonium group. It is particularly preferred that the compound has a water-solubilizing group such as the hydroxyl group, the —$COOM_2$ group or the —$SO_3M_5$ as the substituent furthermore the —$SM_1$ group.

The amino group represented by $R_{21}$, $R_{22}$, $R_{23}$, or $R_{24}$ is a substituted or unsubstituted amino group and the substituent is preferably a lower alkyl group. The ammonium is a substituted or unsubstituted ammonium group, preferably the unsubstituted ammonium group.

Although examples of the compound represented by Formula (S), the compound is not limited thereto.

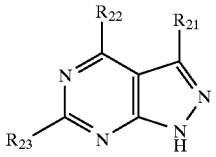

| | $R_{21}$ | $R_{22}$ | $R_{23}$ |
|---|---|---|---|
| S-1 | H | OH | SH |
| S-2 | H | SH | OH |

-continued

| | | | |
|---|---|---|---|
| S-3 | OH | H | SH |
| S-4 | OH | H | SH |
| S-5 | H | $NH_2$ | SH |
| S-6 | H | SK | $SO_3K$ |
| S-7 | COOH | H | SH |

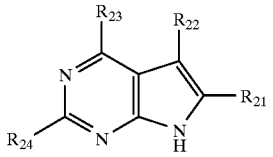

| | $R_{21}$ | $R_{22}$ | $R_{23}$ | $R_{24}$ |
|---|---|---|---|---|
| S-8 | H | H | OH | SH |
| S-9 | Cl | H | $NH_2$ | SH |
| S-10 | SH | H | $NH_2$ | H |
| S-11 | H | H | COOH | SH |
| S-12 | OH | H | H | SH |
| S-13 | H | H | OH | SH |
| S-14 | SH | H | SH | $SO_3H$ |

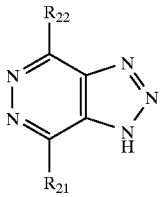

| | $R_{21}$ | $R_{22}$ |
|---|---|---|
| S-15 | SH | OH |
| S-16 | $NH_2$ | SH |
| S-17 | SH | COOH |
| S-18 | SH | $SO_3H$ |
| S-19 | SH | OH |

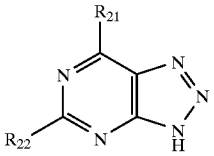

| | $R_{21}$ | $R_{22}$ |
|---|---|---|
| S-20 | SH | COOH |
| S-21 | $NH_2$ | SH |
| S-22 | SH | COOH |
| S-23 | SH | $SO_3H$ |
| S-24 | SH | OH |

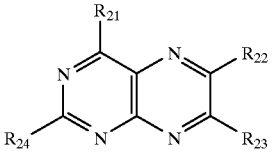

| | $R_{21}$ | $R_{22}$ | $R_{23}$ | $R_{24}$ |
|---|---|---|---|---|
| S-25 | $NH_2$ | H | H | SH |
| S-26 | COOH | H | SH | SH |
| S-27 | OH | H | H | SH |
| S-28 | H | $NH_2$ | H | SH |
| S-29 | SH | COOH | H | H |
| S-30 | H | H | $SO_3H$ | SH |

-continued

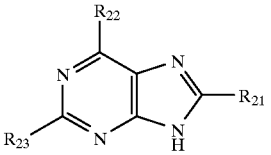

| | $R_{21}$ | $R_{22}$ | $R_{23}$ |
|---|---|---|---|
| S-31 | SH | OH | H |
| S-32 | SH | H | COOH |
| S-33 | H | OH | SH |
| S-34 | $SO_3H$ | SH | SH |
| S-35 | H | SH | $SO_3H$ |
| S-36 | $NH_2$ | H | SH |
| S-37 | $NH_2$ | SH | H |
| S-38 | H | $NH_2$ | SNa |
| S-39 | SH | $NH_2$ | H |

The using amount of the compound represented by Formula S is preferably $10^{-6}$ to $10^{-1}$ moles, more preferably $10^{-5}$ to $10^{-2}$ moles, per liter of the developer.

A sulfite or a metabisulfite such as sodium sulfite, potassium sulfite, ammonium sulfite or sodium metabisulfite can be used as a preservant. The sulfite is preferably used in an amount of not less than 0.25 moles, particularly preferably not less than 0.4 moles, per liter.

An alkaline agent such as sodium hydroxide or potassium hydroxide and a pH buffering agent such as a carbonate, phosphate, borate, acetate, citrate or alkanol amine are preferably added to the developer. As the pH buffering agent, the carbonate is preferable and the adding amount thereof is preferably within the range of 0.5 to 2.5 moles, more preferably 0.75 to 1.5 moles, per liter. Furthermore, a dissolving aid such as a polyethylene glycol or an ester thereof or an alkanolamine, a sensitizer such as a nonionic surfactant including polyoxyethylene or a quaternary ammonium compound, a surfactant, a defoaming agent, an antifoggant, for example, halide compound such as potassium bromide or sodium bromide, a nitrobenzindazole, a nitrobenzimidazole, a benzotriazole, a benzothiazole, a tetrazole or a thiazole, chelating agent such as ethylenediaminetetraacetic acid or an alkali salts thereof, a nitrilotriacetate or a polyphosphate, a developing accelerator such as a compound described on U.S. Pat. No. 2,304,025 or Japanese Patent 47–45541, and a hardener such as glutaraldehyde or a bisulfile adduct thereof, can be added to the developer according to necessity.

<Processing Method>

The processing method of the invention is characterized in that the above-mentioned light-sensitive material is processed using the forgoing developer by an automatic processor in which the washing process is carried out by a multi-step counter flow system (hereinafter referred to a muti-step counter flow washing system) In the multi-step counter flow washing system, the washing tank of the automatic processor is divided to 2 or more parts and washing water is supplied to the last washing tanks to perform the washing treatment.

FIG. 1 is a schima showing the treating process in the automatic processor having the multi-step counter flow washing system. In FIG. 1, 1 is a developing tank, 2 is a fixing tank and 31, 32 and 33 are 3-steps washing tanks. Washing solution is supplied from a supplying tank 51 to the washing tank 33 through pipe 61. The washing solution is passed through the washing tanks 32 and 31 and overflowed through pipe 22 and indroduced in exhausted solution tank 34. 4 is a drying zone, and 5 is a water supplying unit.

A chelating agent such as ethylenediaminetetraacetic acid, citric acid or boric acid, and a germicide such as isothiazoline are preferably added to the washing water. The amount of the chelating agent and the germicide are each usually 0.5 to 100 g, preferably 1 to 50 g, per liter of washing water.

The using amount of washing water can be reduced by the use of the multi-step counter flow washing system. Accordingly, an economic bear caused by washing treatment and the running cost of the processing can be reduced furthermore the reduction of waste water. The supplying amount of washing water is preferably 50 to 500 ml, more preferably 200 to 500 ml, per square meter of the light-sensitive material to be processed.

The exhausted developer can be recovered by applying an electric current. In concrete, a cathode, for example, an electric conductor such as stainless steel or a semiconductor, and an anode, for example, a indissoluble electric conductor such as carbon, gold, platinum or titanium, are immersed in the exhaust developer and in a solution of an electrolyte, respectively, and the exhausted developer tank and the electrolyte solution tank are set so that the tanks are connected through a an anionic ion-exchange membrane, and electric current is applied to recover the developer. The light-sensitive material can be processed while applying the electric current. A component capable of being added to the developer such as a preservant, an alkaline agent, a pH buffering agent, a sensitizer, an antifoggant or a silver sludge preventing agent can be added in the course of the recovering of the developer. In the method of applying electric current while the processing the light-sensitive material, the above-mentioned additives can be added to the developer in the course of the processing.

The method of the invention can be carried out in a from of a process so-called an activator processing. In such the case, the developing agent is containing in an emulsion layer or a layer adjacent to the emulsion layer of the light-sensitive material and the light-sensitive material is developed by a treatment in an alkaline solution. Such the developing process is often applied together with a silver salt stabilizing treatment in combination as a rapid processing method of light-sensitive material. The present invention can be applied to such the processing solution.

An usual fixing solution can be used.

The fixing solution preferably contains a thiosulfate of lithium, potassium, sodium or ammonium and the sodium salt or ammonium salt is more preferable among them. The amount of each of them is usually 0.1 to 5 moles, preferably 0.5 to 2.0 moles, more preferably 0.7 to 1.8 moles, most preferably 0.8 to 1.5 moles, per liter of the developer.

Citric acid, tartaric acid, malic acid, or a lithium, potassium, sodium or ammonium salt thereof, or an optical isomer thereof may be contained in the fixer. A hydrogen lithium salt, a hydrogen potassium salt, a hydrogen sodium salt, a hydrogen ammonium salt, an ammonium potassium salt or a sodium potassium salt of tartaric acid may also be used. Among them, citric acid, iso-citric acid, tartaric acid, succinic acid and a salt thereof are preferred and tartaric acid and its salt are most preferred.

The each of the processing solution may be replenished in a state of liquid or solid.

For reducing the amounts of waste liquids, a prescribed amount, which is proportional to the area of the processed light-sensitive material, of a replenisher is respectively supplied to the developing process and the fixing process. The amounts of the developer replenisher and the fixer replenisher are each preferably not more than 300 ml, more preferably 30 to 300 ml, per square meter of the light-sensitive material, respectively. The replenishing amount is an amount of the replenisher having the same composition as that of the mother liquid in the processing tank. The amount is the total volume of water and the concentrated solution of the replenisher when the replenishing was carried out by the use of a replenisher prepared by diluting a concentrated replenisher, When the replenishing is carried by the use of a replenisher prepared by dissolving a solid processing composition, the amount is the total volume of the solid processing composition and water, and when the solid processing composition and water are separately supplied, the amount is the total of the volume of the solid processing composition and that of water.

When the replenishing amount of the developer is not more than 120 ml per 1 $m^2$ of the light-sensitive material, it is preferred that the developer replenisher is a solution different from the mother liquid in the developing tank or a solid processing composition, and the amount of the silver sludge preventing solution contained in the developer replenisher is preferably larger than that in the developer mother solution, and the amount of the developing agent contained in the developer replenisher is 1.2 to 4 times of that contained in the developer mother liquid. When the amount of fixer replenisher is not more than 150 ml per 1 $m^2$ of light-sensitive material, it is preferred that the fixer replenisher is a solution different from the mother liquid in the fixing tank or a solid processing composition, and the amount of thiosulfate contained in the fixer replenisher is larger than that of thiosulfate contained in the fixer mother liquid.

The developer according to the invention is preferably packed with a material having a low oxygen permeability since the composition of the developer is oxidized by oxygen permeated through the packaging material in the period between the preparation of the kit and the use thereof. The material having a low oxygen permeability includes polyethylene terephthalate (PET), Nylon (Ny), vinylidene chloride-coated Nylon, ethylene-vinyl acetate (EVA), vinyl chloride, a material composed of aluminum foil or a aluminum oxide evaporated layer each of which are laminated with the above-mentioned polymer material, and a material composed of piled up layers of the above-mentioned materials. It is preferred that the oxygen permeating ratio is not more than 50 ml/atm·$m^2$·25° C.·day from the view point of the stability of the developer in the form of kit.

The processes of the developing, fixing and washing are preferably carried out at a temperature within the range of from 10 to 45° C., and each of the processes may be separately controlled at a temperature different from each other.

The whole time of the processing from the insertion of the front of the light-sensitive material into the processor to the taking out of the light-sensitive material from the processor is preferably within the range of from 10 to 80 seconds. The whole processing time includes all the time necessary to process the light-sensitive material, in concrete, the total of the time for the process of developing, fixing, bleaching, washing and drying, namely dry to dry. The whole processing time is more preferably 15 to 44 seconds. The developing time is preferably 2 to 18 seconds for stably running the processing of a lot of the light-sensitive material such as 10 $m^2$ or more.

As the automatic processor, a processor is preferably used which has a heat conductor such as a heating roller heated at 60 to 130° C., or a heat radiator such as a device for radiating heat by applying direct current through tungsten, carbon, tantalum, nichrom, zirconium oxide, yttrium, a mixture of thorium oxide, silicon carbide, molybdenum disilicide or lantern chromate, or a device for radiating infrared rays by conduction heat energy from a resistive heat generating body to a heat radiator made of copper, stainless steel, nickel or various ceramics, heated at a temperature of not less than 150° C., more preferably not less than 250° C.

In the invention, an automatic processor using the method and mechanism described the followings can be preferably used.

(1) Deodorizing device: JP O.P.I. No. 64–37560 p. 544(2), upper left column, through p. 545(3), upper left column
(2) Washing water recovering agent and an apparatus therefor: JP O.P.I. No. 6-250352, p. (3), [0011], through p. (8), [0058]
(3) Method for treating an exhaust liquid: JP O.P.I. No. 2-64638 p. 388(2), lower left column, through p. 391(5), lower left column
(4) A rinsing bath positioned between a developing bath and a fixing bath: JP O.P.I. No. 4-313749, p. (18), [0054], through p. (21), [0065]
(5) A method for controlling wind for drying in an automatic processor according to measuring of the temperature of outside air: JP O.P.I. No. 1-315745 p. 496(2) lower right column, through p.501(7), lower right column, and JP O.P.I. No. 2-108051, p. 588(2), lower left column, through p. 589(3), lower left column
(6) Method for recovering silver in an exhaust fixer: JP O.P.I. No. 6-27623, p. (4), [0012], through p. (7), [0071]

EXAMPLES

Example 1

Preparation of Support

Synthesis of syngiotactic polystyrene

In 200 g of toluene, 100 g of styrene, 56 g of triisobutyl aluminum and 234 g of pentamethyl-cyclopentadienyltitanium methoxide were reacted at 96° C. for 8 hours. The catalyst was decomposed and removed by a methanol solution of sodium hydroxide. Then the reacting liquid was washed 3 times by methanol. Thus 34 parts by weight of sygiotactic polystyrene (SPS) was obtained.

Preparation of SPS film

Thus obtained SPS was fused at 330° C. and extruded through a T-die and rapidly cooled on a cooling dram to obtaining an unextended film. The receiving speed of the cooling drum is varied to two phases. The unextended film having a thickness of 1054 μm was pre-heated at 135° C. and lengthwise extended by 3.1 times and then sidewise extended by 3.4 times. After that, the film was thermally fixed at 250k° C. Thus a support of a diaxially extended film having a bending elasticity of 450 kg/mm$^2$ and a thickness of 100 μm was obtained.

Subbing of SPS film

Silica was evaporated on the both sides of the above-mentioned SPS film and a subbing layer containing styrene-glycidyl acrylate and fine particles of tin oxide was provided as an antistatic treatment.

Preparation of Light-sensitive Material

Preparation of silver halide emulsion A

A silver chlorobromide core grains were prepared by a double-jet mixing method, which is composed of 70 mol-% of silver chloride and the remainder of silver bromide and has an average grain thickness of 0.05 μm and an average diameter of 0.15 μm. At the time of formation of the core grains, $8\times10^{-8}$ moles per mole of silver of $K_3RuCl_6$ was added. A shell was adhered on the core grain by a double-jet mixing method, at the time of the shell formation $3\times10^{-3}$ moles per mole of silver of $K_3RuCl_6$ was added. Thus obtained emulsion was a monodisperse silver iodochloride tabular emulsion with a variation coefficient of 10% which is composed of 90 mole-% of silver chloride, 0.2 mole-% of silver iodide and the remainder of silver bromide, and the silver halide grains thereof each have a (100) face as the major face, which had an average thickness of 0.10 μm and an average diameter of 0.25 μm. The emulsion was desalted by the use of modified gelatin G-8, described in JP O.P.I. No. 2-280139, p. 287(3), in which amino groups of gelatin was substituted by phenylcarbamyl group.

The $E_{Ag}$ value of the desalted emulsion was 190 mV at 50° C. To the emulsion thus obtained, $1\times10^{-3}$ moles per mol silver of 4-hydroxy-6-methyl-1,3,3a,7-tetraazaindene was added. Furthermore, potassium bromide and citric acid were added to adjusting the pH value to 5.6 and the $E_{Ag}$ value to 123 mV. Then emulsion was chemically ripened at 60° C. to attain the maximum sensitivity after addition of $2\times10^{-5}$ moles per mole of silver of chloroauric acid and $3\times10^{-3}$ moles per mole of silver of elemental sulfur.

After completion of the ripening, $2\times10^{-3}$ moles per mole of silver of 4-hydroxy-6-methyl-1,3,3a,7-tetraazaindene, $3\times10^{-4}$ moles per mole of silver of 1-phenyl-5-mercaptotetrazole and gelatin were added to the emulsion.

Preparation of silver halide emulsion B

By a double-jet mixing method, silver chloroiodobromide core grains composed of 60 mole-% of silver chloride, 2.5 mole-% of silver iodide and the remainder of silver bromide were prepared which had an average thickness of 0.05 μm and an average diameter of 0.15 μm. At the mixing time, $2\times10^{-8}$ moles per mole of silver of $K_3Rh(H_2O)Br_5$ was added. A shell was formed on the core grain by a double-jet mixing method, at this time $3\times10^{-7}$ moles per mole of $K_2IrCl_6$ was added.

Thus obtained emulsion was a core/shell type monodisperse ( ) chloroiodobromide tabular grain emulsion having a variation coefficient of 10%, which is composed of 90 mole-% of silver chloride, 0.5 mole-% of silver iodide and the remainder of silver bromide. The emulsion was desalted using the foregoing modified gelatin G-8. The $E_{Ag}$ value of after the desalting was 180 mV at 50° C.

To the emulsion thus obtained, $1\times10^{-3}$ moles per mol silver of 4-hydroxy-6-methyl-1,3,3a,7-tetraazaindene. Furthermore, potassium bromide and citric acid were added to adjusting the pH value to 5.6 and the $E_{Ag}$ value to 123 mV. Then emulsion was chemically ripened at 60° C. to attain the maximum sensitivity after addition of $2\times10^{-5}$ moles per mole of silver of chloroauric acid and $3\times10^{-3}$ moles per mole of silver of N,N,N'-trimethyl-N'-heptafluoroselenourea.

After completion of the ripening, $2\times10^{-3}$ moles per mole of silver of 4-hydroxy-6-methyl-1,3,3a,7-tetraazaindene, $3\times10^{-4}$ moles per mole of silver of 1-phenyl-5-mercaptotetrazole and gelatin were added to the emulsion.

Preparation of a silver halide photographic light-sensitive material for graphic arts scanner having a laser light source On a surface of the subbing layer of the foregoing support the following layers were simultaneously coated in the following order from the support; a gelatin subbing layer according to the following receipt 1 having the gelatin coating amount of 0.5 g/m$^2$, silver halide emulsion layer 1 according to receipt 2 having coating amounts of silver and gelatin of 1.5 g/m$^2$ and 0.5 g/m$^2$, respectively, an inter protective layer according to the following receipt 3 having a gelatin coating amount of 0.3 g/m$^2$, silver halide emulsion layer 2 according to receipt 4 having coating amounts of silver and gelatin of 1.4 g/m$^2$ and 0.4 g/m$^2$, and an emulsion protective layer according to receipt 5 having a gelatin coating amount of 0.8 g/m$^2$. On the other side of the support, the following layers were simultaneously coated in the following order from the support, a backing layer according to receipt 6 having a gelatin coating amount of 0.6 g/m$^2$, a hydrophobic resin layer according to receipt 7, and a backing protective layer according to receipt 8 having a gelatin coating amount of 0.4 g/m$^2$.

| | |
|---|---|
| Receipt 1 (Gelatin subbing layer) | |
| Gelatin | 0.5 g/m$^2$ |
| Dispersion of solid particles of dye AD-1 (average diameter: 0.1 μm) | 25 mg/m$^2$ |
| Sodium polystyrenesulfonate | 10 mg/m$^2$ |
| S-1 (Sodium-iso-amyl-n-decylsulfosuccinate) | 0.4 mg/m$^2$ |
| Receipt 2 (Silver halide emulsion layer 1) | |
| Silver halide emulsion A | 1.5 g/m$^2$ in terms of silver |
| Dispersion of solid particles of dye AD-8 (average diameter: 0.1 μm) | 20 mg/m$^2$ |
| Cyclodextrin (hydrophilic polymer) | 0.5 g/m$^2$ |
| Sensitizing dye d-1 | 5 mg/m$^2$ |
| Sensitizing dye d-2 | 5 mg/m$^2$ |
| Quaternary onium compound | See Table 1 |
| Redox compound: RE-1 | 20 mg/m$^2$ |
| Compound e | 100 mg/m$^2$ |
| Latex polymer f | 0.5 g/m$^2$ |
| Hardener g | 5 mg/m$^2$ |
| S-1 | 0.7 mg/m$^2$ |
| 2-mercapto-6-hydroxypurine | 5 mg/m$^2$ |
| Ethylenediaminetetraacetic acid (EDTA) | 30 mg/m$^2$ |
| Colloidal silica (average diameter: 0.05 μm) | 10 mg/m$^2$ |
| Receipt 3 (Interlayer) | |
| Gelatin | 0.3 g/m$^2$ |
| S-1 | 2 mg/m$^2$ |
| Receipt 4 (Silver halide emulsion layer 2) | |
| Silver halide emulsion B | 1.4 g/m$^2$ in terms of silver |
| Sensitizing dye d-1 | 3 mg/m$^2$ |
| Sensitizing dye d-2 | 3 mg/m$^2$ |
| Compound H-1 | 5 mg/m$^2$ |
| Nucleation accelerating agent Nb-1 | 40 mg/m$^2$ |
| 2-mercapto-6-hydroxypurine | 5 mg/m$^2$ |
| EDTA | 20 mg/m$^2$ |
| Latex polymer f | 0.5 g/m$^2$ |
| S-1 | 1.7 mg/m$^2$ |
| Receipt 5 (Emulsion protective layer) | |
| Gelatin | 0.6 g/m$^2$ |
| Dispersion of solid particles of dye AD-5 (average diameter: 0.1 μm) | 40 mg/m$^2$ |
| S-1 | 12 mg/m$^2$ |
| Matting agent (monodispersed silica having an average diameter of 3.5 μm) | 25 mg/m$^2$ |
| Nucleation accelerating agent Na-1 | 40 mg/m$^2$ |
| 1,3-vinylsulfonyl-2-propanol | 40 mg/m$^2$ |
| Surfactant h | 1 mg/m$^2$ |
| Colloidal silica (average diameter: 0.05 μm) | 10 mg/m$^2$ |
| Hardener: K-1 | 30 mg/m$^2$ |
| Receipt 6 (Backing layer) | |
| Gelatin | 0.6 /m$^2$ g |
| S-1 | 5 mg/m$^2$ |
| Latex polymer f | 0.3 g/m$^2$ |
| Colloidal silica (average diameter: 0.05 μm) | 70 mg/m$^2$ |
| Sodium polystyrenesulfonate | 20 mg/m$^2$ |
| Compound i | 100 mg/m$^2$ |
| Receipt 7 (Hydrophobic polymer layer) | |
| Latex (methylmethacrylate:arylic acid = 97:3) | 1.0 g/m$^2$ |
| Hardener g | 6 mg/m$^2$ |
| Receipt 8 (Backing protective layer) | |
| Gelatin | 0.4 g/m$^2$ |
| Matting agent (polymethyl methacrylate having an average diameter of 5 μm) | 50 mg/m$^2$ |
| Sodium di-(2-ethylhexyl)-sulfosuccinate | 10 mg/m$^2$ |
| Surfactant h | 1 mg/m$^2$ |
| Dye k | 20 mg/m$^2$ |
| $HO(CH_2CH_2O)_{68}H$ | 50 mg/m$^2$ |
| Hardener K-1 | 20 mg/m$^2$ |

Compound i

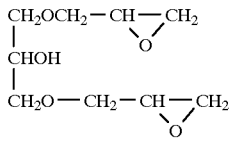

Dye k

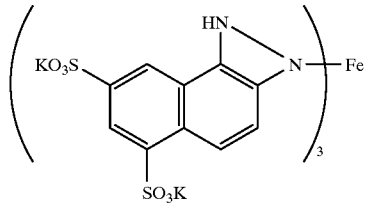

RE-1

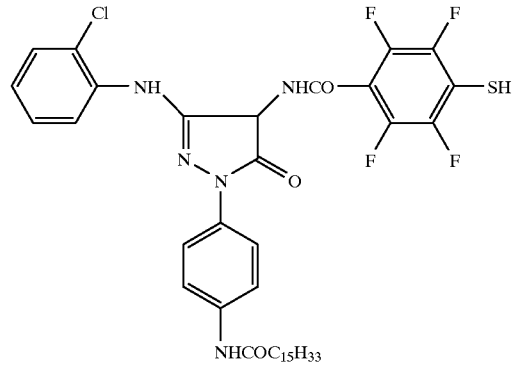

K-1

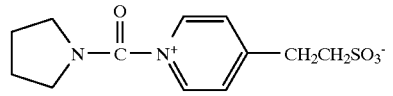

Sensitizing dye d-1

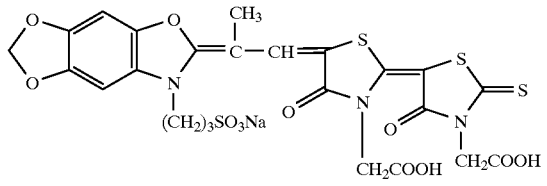

Sensitizing dye d-2
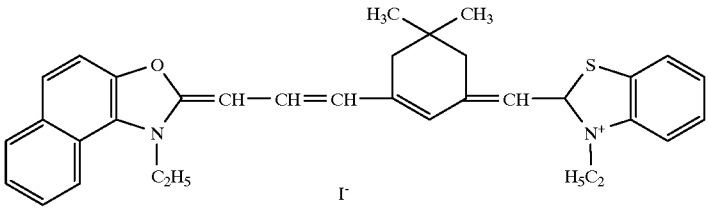
Compound e
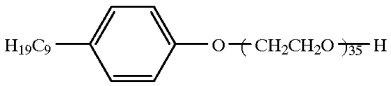
Latexpolymer f
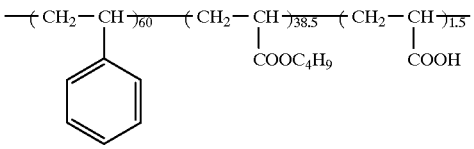
Hardener g Surfactant h
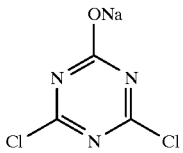
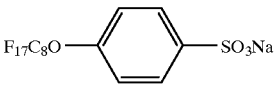
AD-1
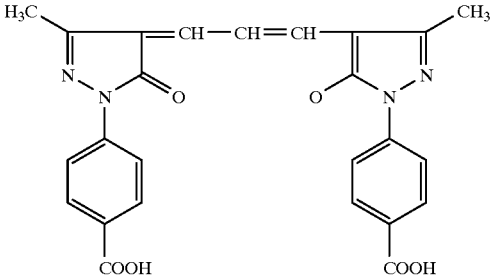
AD-5
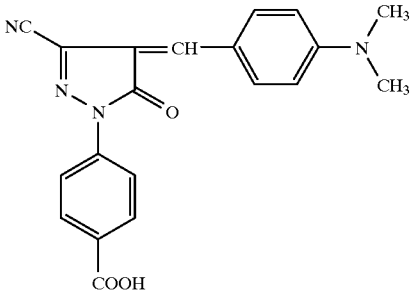
AD-8
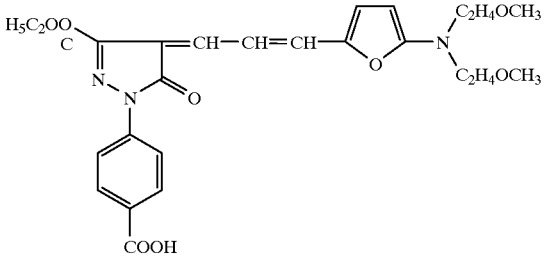
H-1
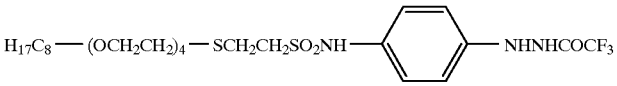

Na-1

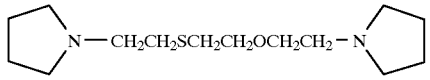

Nb-1

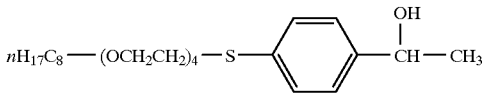

The surface specific resistivity of the backing side was $6\times10^{11}$ Ω/□ at 23° C. and RH of 20%, and the pH of the surface of the emulsion side was 5.5 and the swelling rate was 175%.

Preparation of Processing Solutions

Receipt of processing solutions

Developer (per 1 liter of using solution)

| | D-1 Comparative | D-2 Inventive | D-3 Inventive |
|---|---|---|---|
| Bio-decomposable chelating agent Ch | 10 g | 10 g | 10 g |
| Sodium sulfite | 45 g | 45 g | 45 g |
| Potassium carbonate | 50 g | 50 g | 50 g |
| 8-mercaptoadenine | 0.2 g | 0.2 g | 0.2 g |
| Diethylene glycol | 50 g | 50 g | 50 g |
| 5-methylbenzotriazole | 0.3 g | 0.3 g | 0.3 g |
| 1-phenyl-5-mercaptotetrazole | 0.6 g | 0.6 g | 0.6 g |
| 1-phenyl-4-hydroxymethyl-4-methyl-3-pyrazolidone (Dimezone S) | 1.1 g | 1.5 g | — |
| N-methy-p-aminophenol | — | — | 7 g |
| Sodium erythorbate | 0 | 60 g | 50 g |
| Hydroquinone | 20 g | — | — |
| Diethylaminopropanediol | 25 g | 25 g | 25 g |
| Compound TO-1 | 0.2 g | 0.2 g | 0.2 g |
| Water to make | 1 liter | 1 liter | 1 liter |
| Adjust pH to | 10.3 | 9.5 | 9.5 |

Bio-decomposable chelating agent Ch

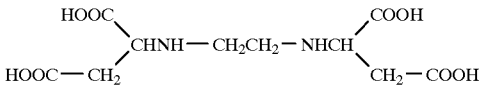

COMPOUND TO-1

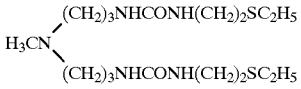

Fixer (per 1 liter of using solution)

| | |
|---|---|
| Pure water | 120 ml |
| Ammonium thiosulfate (containing 10% of sodium salt, manufactured by Hoechst Co., Ltd.) | 140 g |
| Sodium sulfite | 22 g |
| Boric acid | 10 g |
| Tartaric acid | 3 g |
| Sodium acetate trihydrate | 37.8 g |
| Acetic acid (90% aqueous solution) | 13.5 g |

-continued

| | |
|---|---|
| Aluminum sulfate 18-hydrate | 18 g |
| Isoelite P (manufactured by Ensuikou Seitou) | 5 g |
| Make to 500 ml (pH 4.83) using pure water and 50% sulfuric acid solution. At the time of use, 500 ml of the above-mentioned concentrated solution is mixed with 500 ml of pure water. | |

Washing solution (per 1 liter of using solution)

| | |
|---|---|
| Bio-decomposable chelating agent Ch | 40 g |
| Potassium sulfite | 35 g |
| Potassium carbonate | 50 g |
| 8-mercaptoadenine | 0.1 g |
| Anti-mold agent Sanbac-P (manufactured by San-ai Sekiyu Co., Ltd) | 20 g |
| Water to make | 1 liter |

Automatic Processor

Automatic Processor GR-26SR having an one-step washing system, manufactured by Konica Corp., and a modified Automatic Processor GR-26SR in which the washing process is modified to a three-step counter flow system shown in FIG. 1 were used. The replenishing amount of washing water was 300 ml/m$^2$, and water overflowed from the washing process was used for diluting the fixer to be used as fixer replenisher. While the processing was performed, 130 ml of the above-mentioned developer and 130 ml of the fixer per 1 m$^2$ of the light-sensitive material were respectively supplied. In FIG. 1, 1 is a developing tank, 2 is a fixing tank, and 31, 32 and 33 are three-step washing tanks, 4 is a drying zone, 5 is a water supplying tank, 51 is a water supplying unit, 6, 61 and 62 are pipings and 7 is a dehumifier. The washing water was supplied to the last washing tank 33 and overflowed from the first washing tank 31.

Each of the automatic processors has a far-infrared rays heater in the drying zone and a cover covering the whole surface of the liquids other than the developer in the processing tanks for inhibiting evaporation of the processing solutions.

Processing Condition

| | Temperature | Time |
|---|---|---|
| Developing | 38° C. | 15 seconds |
| Fixing | 38° C. | 8 seconds |
| Washing | 38° C. | 10 seconds |
| Squeezing | | 2 seconds |
| Drying | 40° C. | 10 seconds |
| Total | | 45 seconds |
| Line speed (transportation speed) | | 3300 mm/minute |

The exhausted fixer was recycled to the fixing tank after recovering silver from the solution by a silver recovering apparatus described in JP O.P.I. No. 6-27623, and water overflowed from the washing tank was treated by a furring inhibiting apparatus "Mizukirei" manufactured by Konica Corp.

Evaluation method

The sample was step wise exposed to light by a scanner SG-747RU, manufactured by Dainihon Screen Co., Ltd., through a random pattern screen (FM screen) and processed to evaluate. In the processing, the developer was used after standing for 3 days at a temperature of 55° C. and a relative humidity of 50%.

The processing was carried out under the above-mentioned conditions and the samples were processed at the initial and after running of the processing in which 100 m$^2$ of the sample was processed to compare the photographic properties of the samples. In the running, an unexposed sheet of the sample and a sheet of the sample uniformly exposed to light were reciprocally processed so that the blackened ratio of the sample was 50%. After processing, the obtained samples were stored for 3 days at 50% and a relative humidity of 80%.

Evaluation of color remaining

The unexposed portion of the sample was cut in a size of 3 cm×10 cm. Five pieces of the cut sample were stacked and the color thereof was visually evaluated. A sample without any remaining color was ranked as Rank 5, and the rank was lowered 4 to 1 according to the degree of the remained color. The color remaining of Rank 1 or 2 is a lavel not acceptale for practical use.

Evaluation of storage ability of image

The density at the blackened area of the dot image was measured before and after the storage to determine the lowering of the density in the course of the storage. Macbeth densitometer was used for measuring the density. Furthermore, degree of tone change black to brown of the image formed in the sample was visually evaluated. The samples were classified to five ranks according to the degree of density lowering and the change of tone. The sample without any lowering density and tone change was ranked as rank 5, and the rank was lowered 4 to 1 according to increasing in the change of density and tone. The change of density and tone of image classified as Rank 2 or 1 is a lavel not acceptable fro practical use.

Results of the above-mentioned experiments are listed in Table 1.

TABLE 1

| | Quaternary onium compound in light-sensitive material | | | | Initial time of running | | Completion time of running | | |
|---|---|---|---|---|---|---|---|---|---|
| Sample No. | Structure | Adding amoun (Mol/L) | Developer | Automatic processor | Color remaining | Image storage ability | Color remaining | Image storage ability | Note |
| 101 | — | | D-1 | GR-26SR | 1 | 2 | 1 | 1 | Comp. |
| 102 | — | | D-2 | GR-26SR | 1 | 2 | 1 | 1 | Comp. |
| 103 | P-35 | $2 \times 10^{-3}$ | D-1 | GR-26SR | 1 | 2 | 1 | 1 | Comp. |
| 104 | P-35 | $2 \times 10^{-3}$ | D-2 | GR-26SR | 2 | 2 | 2 | 2 | Comp. |
| 105 | P-35 | $2 \times 10^{-3}$ | D-2 | Modi-fied | 4 | 5 | 4 | 5 | Inv. |
| 106 | P-27 | $2 \times 10^{-3}$ | D-2 | Modi-fied | 4 | 5 | 4 | 5 | Inv. |
| 107 | P-27 | $2 \times 10^{-3}$ | D-3 | Modi-fied | 4 | 5 | 4 | 5 | Inv. |
| 108 | P-35 | $2 \times 10^{-3}$ | D-3 | Modi-fied | 4 | 5 | 4 | 5 | Inv. |
| 109 | P-35 | $2 \times 10^{-3}$ | D-1 | Modi-fied | 2 | 2 | 2 | 2 | Comp. |

Example 2

Preparation of Silver Halide Photographic Light-sensitive Material for Contact Printing Preparation pf silver halide emulsion C Cubic silver chlorobromide grains were prepared by a double-jet mixing method, which have a silver chloride content of 99 mole-%, a silver bromide content of 1 mole-%, and an average grain diameter of 0.15 μm. In the course of mixing, $7\times10^{-5}$ moles per mole of silver of $K_3Rh(H_2O)Br_5$ was added. Before desalting process according to an ordinary method, 0.6 g pre mole of silver of 4-hydroxy-6-methyl-1,3,3a,7-tetraazaindene (TAI) was added, hereinafter the amount of the compnent is described in an amount per mole of silver except when a specific description is added.

The emulsion was heated by 60° C., and 6° C. mg of TAI, 0.75 mg of sodium thiosulfate were added to the emulsion. Sixty minutes later the addition of TAI, 600 mg of TAI was further added, then the emulsion was set by cooling. Thus obtained emulsion was referred to Emulsion C.

To prepare a coating liquid, the following additives were added to the emulsion so that the coating amounts per 1 $m^2$ were the followings. The emulsion coating liquid, and a lower and upper protective layer coating liquids were coated on a side of the subbed SPS support in this order and a backing coating liquid was coated on another side of the support. These layers were coated simultaneously.

Emulsion Coating Liquid

| | |
|---|---|
| Siver halide emulsion C | 2.0 $g/m^2$ in terms of silver |
| Gelatin | 1.2 $g/m^2$ |
| 0.5 N NaOH solution | 4.39 $ml/m^2$ |
| Compound A | 6.53 $mg/m^2$ |
| Quaternary onium compound | An amount described in Table 2 |
| Saponine | 107 $mg/m^2$ |
| Compound B | 18.5 $mg/m^2$ |
| Compound C | 9.8 $mg/m^2$ |

-continued

| | |
|---|---|
| Gelatin-stabilized latex | 480 $mg/m^2$ |
| Sodium polystyrenesulfonate | 52.2 $mg/m^2$ |
| colloidal silica | 20 $mg/m^2$ |
| Lower protective layer coating liquid | |
| Gelatin | 0.5 $g/m^2$ |
| Dispersion of solid particle of Dye D (average diameter: 0.1 μm) | 62.0 $mg/m^2$ |
| Citric acid | 4.1 $mg/m^2$ |
| Formalin | 1.2 $mg/m^2$ |

-continued

| | |
|---|---|
| Hardener K-1 | 0.6 mg/m$^2$ |
| Sodium polystyrenesulfonate | 11.0 mg/m$^2$ |
| Upper protective layer coating liquid | |
| Gelatin | 0.3 g/m$^2$ |
| Compound E | 18.0 mg/m$^2$ |
| Dye D | 48.4 mg/m$^2$ |
| Compound F | 105.0 mg/m$^2$ |
| Compound G | 1.25 mg/m$^2$ |
| Irregular-shaped silica (average diameter: 1.63 $\mu$m) | 15.0 mg/m$^2$ |
| Irregular-shaped silica (average diameter: 3.5 $\mu$m) | 21.0 mg/m$^2$ |
| Citric acid | 4.5 mg/m$^2$ |
| Sodium polystyrenesulfonate | 11.0 mg/m$^2$ |
| Formalin (added by in-line adding system) | 10 mg/m$^2$ |
| Backing layer coating liquid | |
| Gelatin | 2.1 g/m$^2$ |
| Compound H | 170 mg/m$^2$ |
| Dye D | 30 mg/m$^2$ |
| Compound I | 45 mg/m$^2$ |
| Compound J | 10 mg/m$^2$ |
| Kilaya saponine | 111 mg/m$^2$ |
| Compound K | 200 mg/m$^2$ |
| Colloidal silica | 200 mg/m$^2$ |
| Compound L | 35 mg/m$^2$ |
| Compound M | 31 mg/m$^2$ |
| Compound N | 3.1 mg/m$^2$ |
| Polymethyl methacrylate (average particle diameter: 5.6 $\mu$m) | 28.9 mg/m$^2$ |
| Glyoxal | 10.1 mg/m$^2$ |
| Citric acid | 9.3 mg/m$^2$ |
| Sodium polystyrenesulfonate | 71.1 mg/m$^2$ |
| Add the followings through an in-line system | |
| Compound O | 81 mg/m$^2$ |
| Compound P | 88.2 mg/m$^2$ |
| Calcium acetate | 3.0 mg/m$^2$ |
| Hardener K-1 | 10 mg/m$^2$ |

Compound A

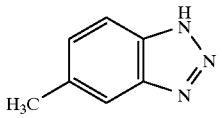

Compound B

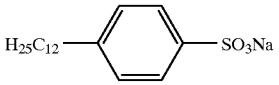

Compound C

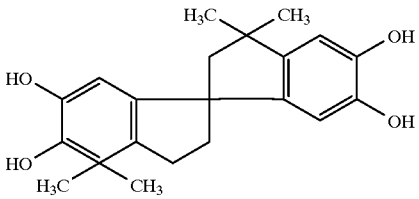

Dye D

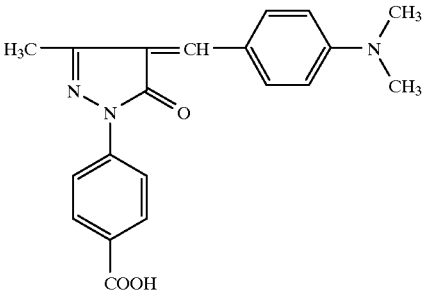

Compound E

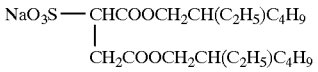

Compound F

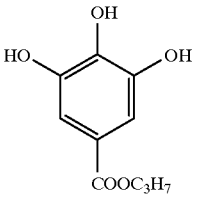

Compound G

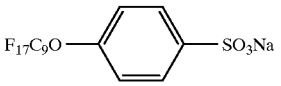

Compound H

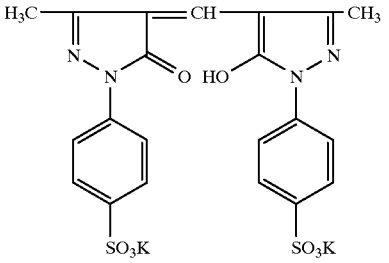

Compound I

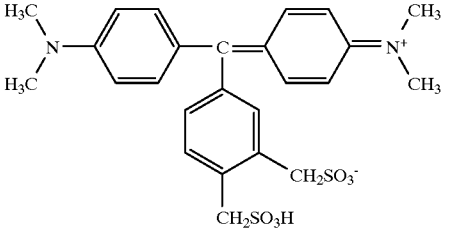

Compound J

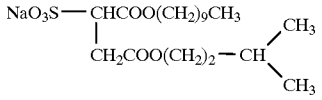

Compound K

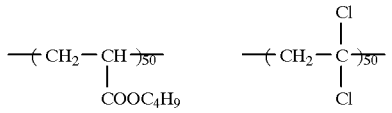

Compound L

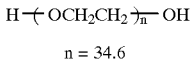

n = 34.6

Compound M

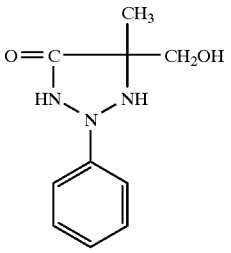

Compound N

Compound C

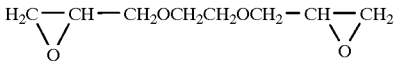

Compound P

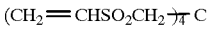

Gelatin-stabilized latex

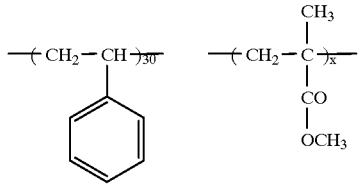

-continued

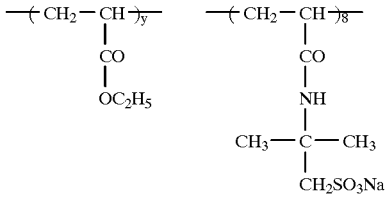

Gelatin: Latex = 5:1, x + y = 62

Preparation of Processing Solutions

Preparation of developer tablet

Part A for Granulation (per 1 liter of using solution)

| | D-11 Comparative | D-12 Inventive |
|---|---|---|
| Bio-decomposable chelating agent Ch | 8 g | 8 g |
| Potassium carbonate | 33 g | 33 g |
| D-mannitol (Kao Co., Ltd.) | 5 g | 5 g |

Part B fro Granulation (per 1 liter of using solution)

| | | |
|---|---|---|
| Sodium sulfite | 45 g | 16 g |
| KBr | 2.5 g | 2.5 g |
| Potassium hydrogen carbonate | 50 g | 65 g |
| 8-mercaptoadenine | 0.15 g | 0.15 g |
| 5-mercaptobenzotriazole | 0.5 g | 0.5 g |
| 1-phenyl-5-mercaptotetrazole | 0.02 g | 0.02 g |
| Dimezone S | 2.7 g | 2.7 g |
| Sodium erythorbate | 0 | 70 g |
| Hydroquinone | 25 g | 0 |
| D-sorbitol | 5 g | 5 g |
| Sodium 1-octanesulfonate | 2 g | 2 g |
| Adjust pH to | 10.2 | 9.7 |

The each of the components of Parts A and Parts B were respectively mixed for 30 minutes by a bandal mill available on the market, and granuled for 10 minutes by a stirring granulation machine available on the market. Then the granules were dried by a flowing-bed dryer for 2 hours at 40° C. Thus Granule Part A and Granules Part B were obtained.

Granules Part A and Granules Part B were sufficiently mixed for 10 minutes. Thus prepared mixture was tableted by a tableting machine, Machina UD·DFE·40, manufactured by Machina Co., Ltd., with a tableting pressure of 1.5 ton/$m^2$. Thus 10 tables each having a diameter of 30 mm and a thickness of 10 mm. The filling amount of the tablet of D-11 and that of D-12 were each 17.8 g and 21.0 g per tablet, respectively.

Ten of the tablet were dissolved in pure water so that the volume of the solution was 1 liter and the pH value of the solution was adjusted at the time of the use thereof.

Evaluation Method

The developer was stood for 3 days under conditions of a temperature of 55° C. and a relative humidity of 50%. The developer was evaluated in the same manner as in example 1. The automatic processors used in Example 1 were modified so that the tablet of the processing composition could be supplied one by one from the upper portion of the processor.

The photographic properties at the initial time of processing and those after treatment of 200 $m^2$ of the light-sensitive material were compared. In the course of the running of the processing, eight sheets of unexposed sample -and two sheets of uniformly exposed sample were alternatively processed so that the blackening ratio was become 20%.

Thus obtained results are shown in Table 2.

TABLE 2

| Sample No. | Quaternary onium compound in light-sensitive material: Structure | Quaternary onium compound in light-sensitive material: Adding amount (Mol/L) | Developer | Automatic processor | Initial time of running: Color remaining | Initial time of running: Image storage ability | Completion time of running: Color remaining | Completion time of running: Image storage ability | Note |
|---|---|---|---|---|---|---|---|---|---|
| 201 | None | | D-11 | GR-26SR* | 1 | 2 | 1 | 1 | Comp. |
| 202 | None | | D-12 | GR-26SR* | 1 | 2 | 1 | 1 | Comp. |
| 203 | T-7 | $1 \times 10^{-3}$ | D-11 | GR-26SR* | 1 | 2 | 1 | 1 | Comp. |
| 204 | T-7 | $1 \times 10^{-3}$ | D-12 | GR-26SR* | 2 | 2 | 2 | 2 | Comp. |
| 205 | T-7 | $1 \times 10^{-3}$ | D-12 | Modified* | 5 | 5 | 5 | 5 | Inv. |
| 206 | T-2 | $1 \times 10^{-3}$ | D-12 | Modified* | 5 | 5 | 5 | 5 | Inv. |
| 207 | T-7 | $1 \times 10^{-3}$ | D-11 | Modified* | 2 | 2 | 2 | 2 | Comp. |

*:Modified so that the tablet of the developer composition can be supplied.

What is claimed is:

1. A method for processing a black-and-white photographic light-sensitive material comprising the steps of developing the black-and-white photographic light-sensitive material containing $1\times10^{-8}$ to 1.0 mols of a quaternary onium compound per mol of silver halide with a developer containing 0.05 to 1.0 mols of ascorbic acid or a derivative thereof per liter of said developer and $10^{-6}$ to $10^{-1}$ mols of a compound of Formula S per liter of developer, said developer having a pH value of from 8.0 to 10.0;

fixing the light-sensitive material;

washing the light-sensitive material by an automatic processor having a multi-step counter flow washing system, and drying the light-sensitive material;

Formula S $$Z_1—SM_1$$

wherein $Z_1$ is an alkyl group, an aromatic group or a heterocyclic group, each of which has a substituent selected from the group consisting of hydroxyl, $—SO_3M_2$, $—COOM_2$, amino, and ammonio, wherein $M_2$ is hydrogen, alkali metal, or amidino.

2. The method of claim 1, wherein the developer contains a 3-pyrazolidone compound.

3. The method of claim 1, wherein the developer contains an aminophenol compound.

4. The method of claim 1, wherein the whole duration from the time at which the light-sensitive material is inserted in the automatic processor, to the time at which the light-sensitive material is come out from a drying zone of the automatic processor, is within the range of from 10 seconds to 80 seconds.

5. The method of claim 1, wherein the developer is replenished with a developer replenisher in a rate of 30 ml to 250 ml per square meter of the light-sensitive material to be processed.

* * * * *